US006072515A

United States Patent [19]

Miura

[11] Patent Number: 6,072,515

[45] Date of Patent: Jun. 6, 2000

[54] IMAGE MARKING DEVICE ADAPTED TO REDUCE AN EXTERIOR ENVELOPE THEREOF

[75] Inventor: Tsutomu Miura, Tsuzuki-ku, Japan

[73] Assignee: Eastman Kodak Company, Rochester, N.Y.

[21] Appl. No.: 08/840,092

[22] Filed: Apr. 11, 1997

[51] Int. Cl.[7] ..... B41J 2/32

[52] U.S. Cl. ..... 347/222; 271/162; 347/171; 347/218

[58] Field of Search ..... 347/171, 172, 347/174, 176, 222, 218; 400/120.01, 622, 624; 271/145, 162; 312/333

[56] References Cited

U.S. PATENT DOCUMENTS

| | | | |
|---|---|---|---|
| 3,919,972 | 11/1975 | Komori et al. . | |
| 4,623,900 | 11/1986 | Watanabe | 347/176 |
| 5,563,646 | 10/1996 | Fukuda | 347/171 |
| 5,823,647 | 10/1998 | Miyoshi | 312/333 |

*Primary Examiner*—Huan Tran
*Attorney, Agent, or Firm*—Walter S. Stevens

[57] ABSTRACT

An image marking device adapted to reduce an exterior envelope thereof. The image marking device comprises a housing having an exterior surface and a slot formed through the exterior surface. An image forming location, such as a print head, is disposed in the housing for printing an image on a recorder medium supplied from a supply tray received in the slot. The tray and the housing define the exterior envelope. The tray is inwardly slidable in the slot from an extended position to an inserted position. A guide ramp is disposed in the housing for guiding the recorder medium from the supply tray to the print head and extends from near the tray to near the print head. The guide ramp has a hinged end portion disposed adjacent the tray in a first position as the tray is extended and inwardly movable to a second position to allow the tray to be fully inserted into the slot. The exterior envelope of the image marking device is reduced as the hinged end portion is moved to the second position to allow the tray to travel to the fully inserted position in the slot.

18 Claims, 3 Drawing Sheets

IMAGE MARKING DEVICE ADAPTED TO REDUCE AN EXTERIOR ENVELOPE THEREOF

FIELD OF THE INVENTION

The present invention relates generally to image marking devices and methods therefor and, more particularly, to an image marking device adapted to reduce an exterior envelope thereof.

BACKGROUND OF THE INVENTION

A typical image marking device, such as a printer, has an enclosure for enclosing the components of the image marking device, including a suitable print head. Recorder medium is held in a cassette or supply tray partially inserted into the image marking device for supplying the recorder medium to the print head. In this regard, a "picker" mechanism engages the recorder medium held in the supply tray and suitably feeds the recorder medium to the print head. In one type of image marking device, dye donor web containing dye therein is brought into contact with the recorder medium and heat activated by the print head to transfer the dye to the recorder medium in order to print an output image on the recorder medium.

The enclosure and the supply tray define an exterior envelope of the image marking device. However, the supply tray typically projects substantially outwardly from the enclosure. This configuration of the typical image marking device enlarges the exterior envelope of the image marking device. This is undesirable because the enlarged envelope increases the footprint of the image marking device. It is desirable, therefore, to reduce the exterior envelope of the image marking device.

Image marking devices available in the art commonly possess a recorder medium supply tray. One such image marking device and associated supply tray is disclosed in U.S. Pat. No. 3,919,972 titled "Automatic Cut Sheet Feeding Unit" issued Nov. 18, 1975 in the name of Shigehiro Komori, et al. This patent discloses an automatic cut sheet feeding device provided with a cut sheet box with an open top. The box is allowed to move vertically when the number of sheets has been reduced. However, this patent does not disclose an image marking device adapted to reduce an exterior envelope thereof.

Therefore, what has long been needed is an image marking device adapted to reduce an exterior envelope thereof.

SUMMARY OF THE INVENTION

The invention resides in an image marking device adapted to reduce an exterior envelope thereof, comprising a housing having an outside surface and an opening formed through the outside surface; an image forming location disposed in said housing for printing an image on a recorder medium; a supply tray capable of supplying the recorder medium therefrom to said image forming location and sized to be received in the opening, said tray being movable in the opening from a partially inserted position to a more fully inserted position, said tray and said housing defining the exterior envelope, whereby the exterior envelope is reduced as said tray more fully inserts in the opening; and a guide aligned with said tray for defining a guide path extending from said tray to said image forming location, said guide initially interfering with sliding said tray from the partially inserted position to the more fully inserted position, said guide being movable for subsequent interference-free sliding of said tray from the partially inserted position to the more fully inserted position.

An object of the present invention is to provide an image marking device adapted to reduce an exterior envelope thereof.

A feature of the present invention is the provision of a guide having a hinged end portion movable from a first position to a second position in order that a recorder medium supply tray may be fully inserted into the image marking device.

An advantage of the present invention is that use thereof reduces the exterior envelope of the image marking device.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the detailed description of the preferred embodiments of the invention presented hereinbelow, reference is made to the accompanying drawings, in which.

DETAILED DESCRIPTION OF THE INVENTION

Figure 1:
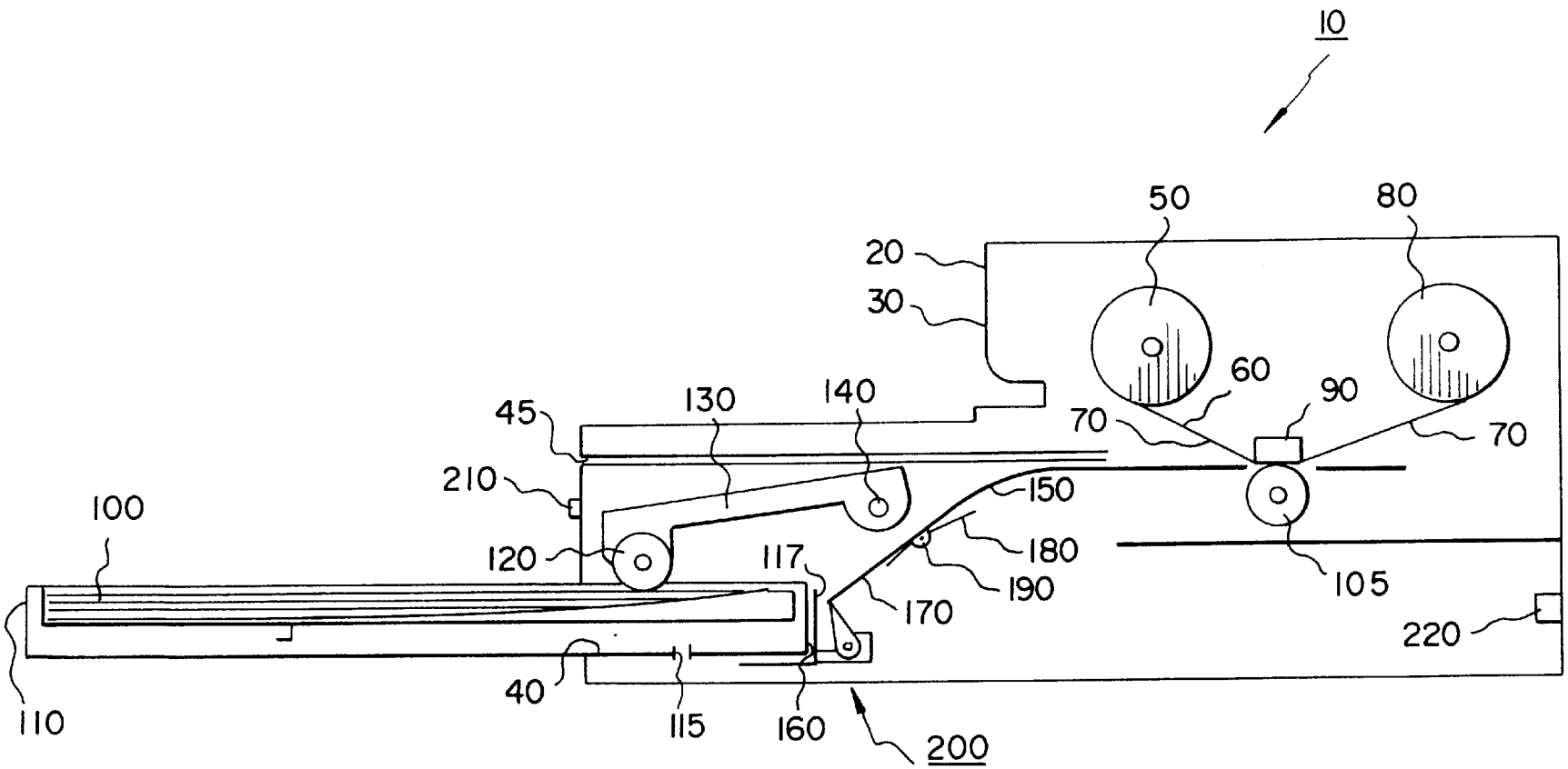
FIG. 1 is a view in partial vertical section, with parts removed for clarity, of an image marking device, this view also showing an enclosure having a slot therein receiving a supply tray partially inserted into the slot.
Figure 2:
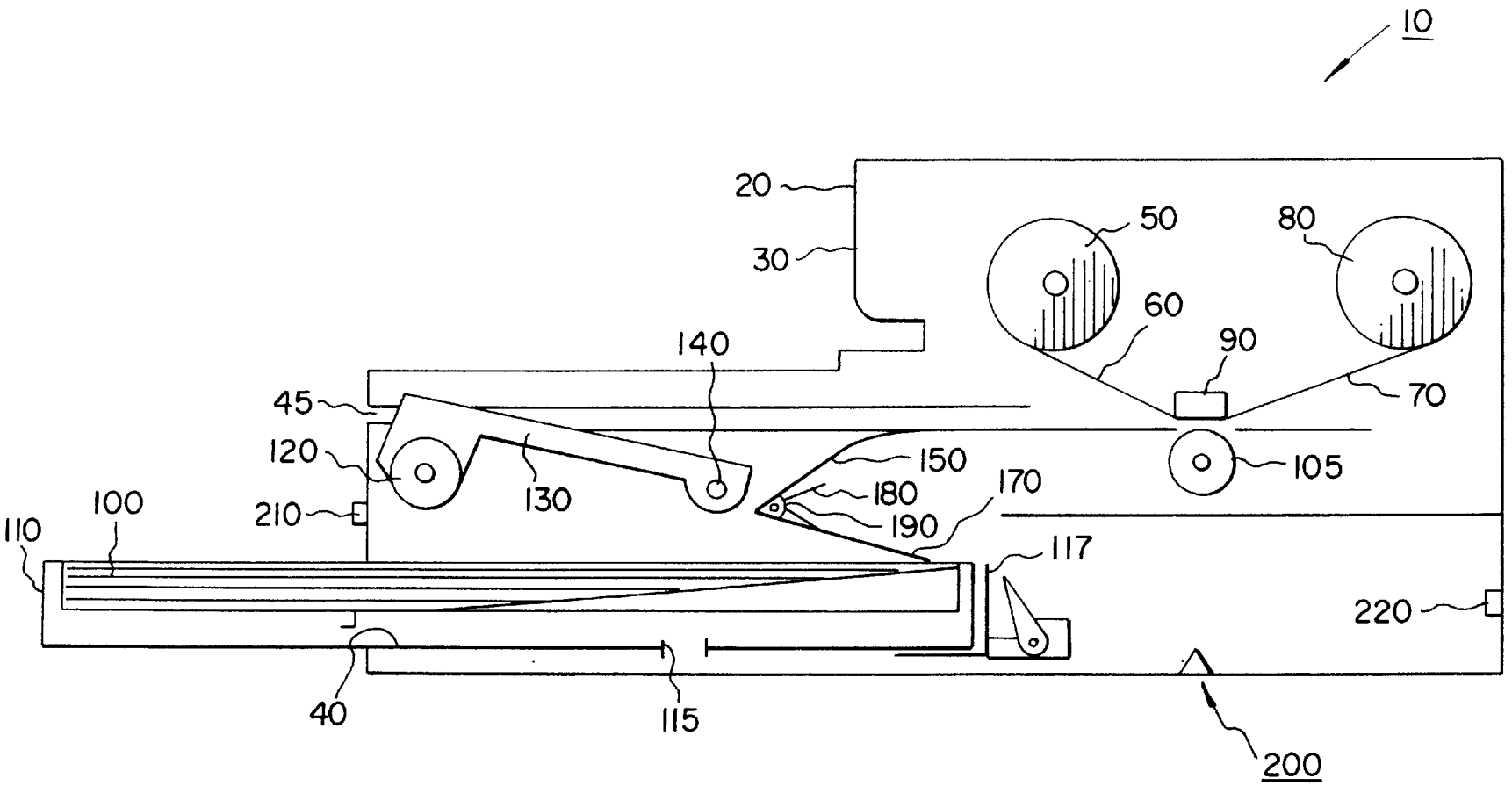
FIG. 2 is a view in partial vertical section of the image marking device showing the supply tray more fully inserted into the slot.
Figure 3:
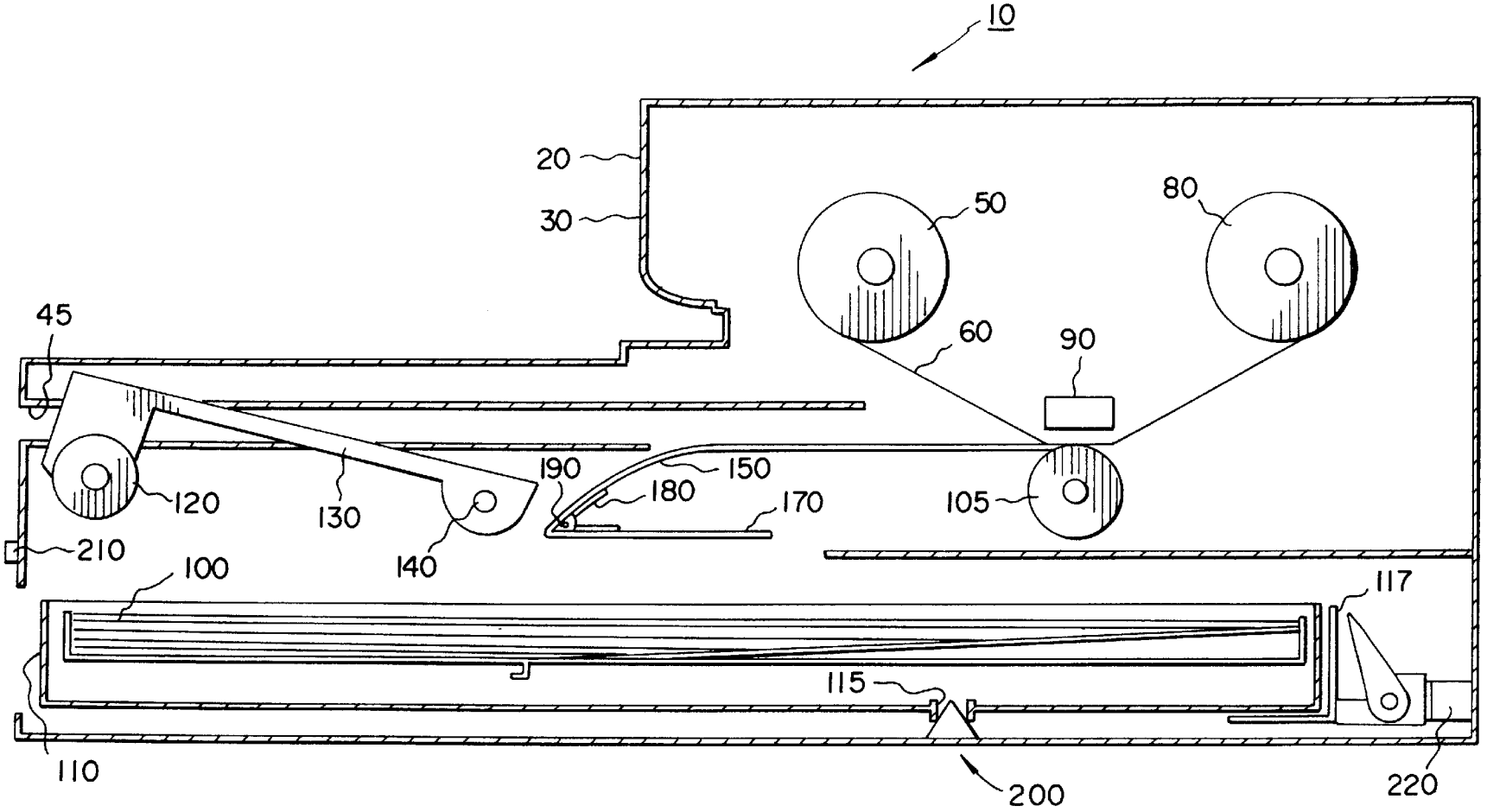
FIG. 3 is an enlarged view in partial vertical section of the image marking device showing the supply tray fully inserted into the slot.

Referring to FIGS. 1, 2 and 3, an image marking device, generally referred to as 10, comprises a housing 20 having an outside surface 30 and an opening 40, which may be in the shape of a slot, formed through outside surface 30. Housing 20 also has a exit channel 45 therein for reasons disclosed hereinbelow. In the preferred embodiment of the invention, a supply reel 50 is disposed in housing 20 for supplying a dye donor web or ribbon 60 from about supply reel 50. Dye donor ribbon 60 has a dye releasable therefrom when dye donor ribbon 60 is heated. Dye donor ribbon 60 also has a portion 70 thereof extending outwardly from supply reel 50. A take-up reel 80 is disposed in housing 20 and engages extended portion 70 of dye donor ribbon 60 in order to receive dye donor ribbon 60 about take-up reel 80. An image forming location, such as a print head 90, is disposed in housing 20 and is located adjacent dye donor ribbon 60 for applying heat to dye donor ribbon 60, so that dye donor ribbon 60 is heat-activated to release the dye therefrom. When the dye is released, an output image is printed on a recorder medium 100, which may be cut sheets of paper or transparency. In the embodiment of the invention disclosed herein, recorder medium 100 is controllably moved past print head 90 by suitable means, such as by means of a platen roller 105 rotatably disposed adjacent print head 90. Alternatively, recorder medium 100 may be moved by means (not shown) other than platen roller 105. However, in the embodiment disclosed herein, it is platen roller 105 that rotates to move recorder medium 100. In this manner, recorder medium 100 passes adjacent to print head 90 to allow print head 90 to print the output image thereon. When the output image is completely printed on recorder medium 100, platen roller 105 rotates in a direction so as to transfer recorder medium 100 through exit channel 45 and out housing 20.

Again referring to FIGS. 1, 2 and 3, a recorder medium supply reservoir, such as a cassette or supply tray 110, extends outwardly from housing 20 for supplying recorder medium 100 therefrom and may have a notch 115 therein for reasons disclosed hereinbelow. Supply tray 110 is sized to be received in opening 40, the supply tray 110 being inwardly slidable in opening 40 from an extended position (see FIG. 1) to an "inserted position (see FIGS. 2 and 3). The terminology "inserted position" used herein means a position of supply tray 110 which is more fully inserted into opening 40 than when supply tray 110 is in its extended position. In the preferred embodiment of the invention, supply tray 110 is fully inserted into opening 40. Tray 110 may be carried in a cradle 117 which is slidable along an elongate guide rail (not shown), which in turn extends approximately the length of slot 40. Of course, the exterior surfaces of supply tray and housing 20 define an exterior envelope of image marking device 10. It is understood from the description hereinabove, that image marking device 10 may be a resistive thermal printer. However, image marking device 10 may also be an ink jet printer, an electrophotographic printer, or other form of printer. As used herein, the terminology "printer" is intended to include copiers, facsimile machines, and similar devices where images are applied to a recorder medium.

Referring again to FIGS. 1, 2 and 3, recorder medium 60, which is held in supply tray 110, is "picked" therefrom by a picker roller 120 mounted for rotation on a picker arm 130 pivotable about a pivot pin 140. In order to "pick" a cut sheet of recorder medium 100 from supply tray 110, picker arm 130 pivots about pivot pin 140 downwardly toward recorder medium 100. Picker roller 120 will engage recorder medium 100 as picker roller 120 rotates, so that recorder medium 100 is "picked" by means of frictional engagement with picker roller 120. As recorder medium 100 is picked from supply tray 110, recorder medium 100 will exit supply tray 110 and travel to print head 90 to receive the output image thereon.

Still referring to FIGS. 1, 2 and 3, a guide ramp 150 is disposed in housing 20 and extends from near a posterior end 160 of tray 110 to near print head 90 for guiding recorder medium 100 to print head 90. Thus, guide ramp 150 is aligned with tray 110 for defining a guide path extending from tray 110 to print head 90. However, guide ramp 150 initially interferes with sliding movement of tray 110 form the extended position to the inserted position. That is, guide ramp 150 includes an end portion 170 thereof disposed adjacent posterior end 160 of tray 110 when tray 110 outwardly extends from opening 40. However, end portion 170 is hinged, as shown. Thus, it is appreciated that guide ramp 150 is not rigid or fixed; rather, guide ramp 150 is hinged. Therefore, according to the present invention, hinged end portion 170 is rotatably biased about a hinge 190, such as by means of a spring 180, as described more fully presently. When pushed by posterior end 160, hinged end portion 170 moves from a first position (see FIG. 1) to a second position (see FIGS. 2 and 3) so that tray 110 is further inwardly insertable into opening 40. Hence, hinged end portion 170 is movable for interference-free sliding of tray 110 from the partially inserted position to the fully inserted position. In this manner, the exterior envelope is reduced as tray 110 is inserted further into opening 40. However, when tray 110 is returned to the extended position for operation of image marking device 10, hinged end portion 120 returns to the first position thereof by means of spring 180 in order to resume its guiding function. Moreover, associated with tray 110 is preferably a locking pin 195 which is disposed at posterior end 160 of tray 110 and which is also preferably slidable along the previously mentioned guide rail (not shown). The purpose of locking pin 195 is to lock hinged end portion 170 in its first position (see FIG. 1) for stable positioning of end portion 170 when tray 110 is in its extended position.

Referring yet again to FIGS. 1, 2 and 3, image marking device 10 may further comprise a locking mechanism, generally referred to as 200, connected to housing 20 and engageable with tray 110 for locking tray 110 in the inserted position. In this regard, locking mechanism 200 may be a tooth-like protuberance capable of releasably engaging notch 115 to maintain tray 110 in a fixed location when tray 110 is further inserted into opening 40. Moreover, image marking device 10 may also include a release mechanism connected to housing 20 for releasing tray 110 from the inserted position, so that tray 110 is returnable to the extended position for proper operation of image marking device 10. In the preferred embodiment, the release mechanism comprises a release button 210 connected to a latch 220, which latch 220 is capable of outwardly pushing tray 110 from the inserted position to the extended position when acted upon by release button 110. In this regard, latch 220 is operable by means of a solenoid motor electrically connected to release button 210 and capable of being activated by release button 210, so that latch 220 releases tray 110 when activated. Alternatively, the release mechanism may be a lever (not shown) mechanically, rather than electrically, connected to latch 220, which lever is movable to activate latch 220 for releasing tray 110. As another example, latch 220 may be an n/off push latch and spring combination so that after tray 110 has been pushed to its fully inserted position, tray 110 can be pushed again and the on/off push latch will push tray 110 along the guide rail to return tray 110 to its extended position.

The invention has been described in detail with particular reference to certain preferred embodiments thereof, but it is understood that variations and modifications can be effected within the spirit and scope of the invention. In addition, many modifications may be made to adapt a particular situation and material to a teaching of the present invention without departing from the essential teachings of the invention.

Therefore, what is provided is an image marking device adapted to reduce an exterior envelope thereof.

PARTS LIST

10 . . . image marking device
20 . . . housing
30 . . . outside surface
40 . . . opening
50 . . . supply reel
60 . . . dye donor ribbon
70 . . . extended portion
80 . . . take-up reel
90 . . . print head
100 . . . recorder medium
105 . . . platen roller
110 . . . supply tray
115 . . . notch
117 . . . cradle
120 . . . picker roller
130 . . . picker arm

140 . . . pivot pin
150 . . . guide ramp
160 . . . posterior end
170 . . . hinged end portion
180 . . . spring
190 . . . hinge
195 . . . locking pin
200 . . . locking mechanism
210 . . . release button
220 . . . latch

What is claimed is:

1. An image marking device adapted to reduce an exterior envelope thereof, comprising:

(a) a housing having an outside surface and an opening formed through the outside surface;

(b) an image forming location disposed in said housing for printing an image on a recorder medium;

(c) a supply tray capable of supplying the recorder medium therefrom to said image forming location and sized to be received in the opening, said tray being movable in the opening from a partially inserted position to a more fully inserted position, said tray and said housing defining the exterior envelope, whereby the exterior envelope is reduced as said tray more fully inserts in the opening; and (d) a guide aligned with said tray for defining a guide path extending from said tray to said image forming location, said guide initially interfering with sliding said tray from the partially inserted position to the more fully inserted position, said guide being movable for subsequent interference-free sliding of said tray from the partially inserted position to the more fully inserted position.

2. The image marking device of claim 1, wherein said guide is movable for interference-free sliding of said tray from the partially inserted position to a fully inserted position.

3. The image marking device of claim 1, further comprising a locking mechanism associated with said housing for locking said tray in the more fully inserted position.

4. The image marking device of claim 1, further comprising a release mechanism associated with said housing for releasing said locking mechanism.

5. An image marking device adapted to reduce an exterior envelope thereof, comprising:

(a) a housing having an outside surface and a slot formed through the outside surface;

(b) a supply reel disposed in said housing for supplying a dye donor ribbon from thereabout, the dye donor ribbon having a dye releasable therefrom and a extended portion extending outwardly from said supply reel;

(c) a take-up reel disposed in said housing and engaging the extended portion for receiving the dye donor ribbon about said take-up reel, so that the dye donor ribbon extends from said supply reel to said take-up reel;

(d) a print head disposed in said housing and adjacent the dye donor ribbon for activating the dye donor ribbon to release the dye therefrom so as to print an image on a recorder medium;

(e) a supply tray capable of supplying the recorder medium therefrom and sized to be received in the slot, said tray being inwardly slidable in the slot from a partially inserted position to a more fully inserted position, said tray and said housing defining the exterior envelope; and (f) a guide ramp disposed in said housing and extending from near said tray to near said print head for guiding the recorder medium therealong from said tray to said print head, said guide ramp having a hinged end portion disposed adjacent said tray in a first position as said tray partially inserts into the slot and movable to a second position so that said tray more fully inserts into the slot, whereby the exterior envelope is reduced as said tray more fully inserts into the slot.

6. The image marking device of claim 5, wherein the hinged end portion of said guide is movable to the second position so that said tray fully inserts into the slot.

7. The image marking device of claim 5, further comprising a spring connected to the hinged end portion of said guide ramp so that the hinged end portion automatically returns to the first position after moving to the second position.

8. The image marking device of claim 5, further comprising a locking mechanism connected to said housing and engageable with said tray for locking said tray in the inserted position.

9. The image marking device of claim 5, further comprising a release mechanism connected to said housing for releasing said tray from the inserted position.

10. A method of reducing an exterior envelope of an image marking device, comprising the steps of:

(a) providing a housing having an outside surface and an opening formed through the outside surface;

(b) providing an image forming location disposed in the housing for printing an image on a recorder medium;

(c) providing a supply tray capable of supplying the recorder medium therefrom to the image forming location and sized to be received in the opening, the tray being movable in the opening from a partially inserted position to a more fully inserted position for reducing the exterior envelope, the tray and the housing defining the exterior envelope; and (d) providing a guide aligned with the tray for defining a guide path extending from the tray to the image forming location, the guide initially interfering with sliding the tray from the partially position to the more fully inserted position, the guide being movable for subsequent interference-free sliding of the tray from the partially inserted position to the more fully inserted position.

11. The method of claim 10, wherein said step of providing a guide comprises the step of providing a guide movable for interference-free sliding of the tray from the partially inserted position to a fully inserted position.

12. The method of claim 10, further comprising the step of providing a locking mechanism associated with the housing for locking the tray in the inserted position.

13. The method of claim 10, further comprising the step of providing a release mechanism associated with the housing for releasing the locking mechanism.

14. A method of reducing an exterior envelope of an image marking device, comprising the steps of:

(a) providing a housing having an outside surface and a slot formed through the outside surface;

(b) providing a supply reel disposed in the housing for supplying a dye donor ribbon from thereabout, the dye donor ribbon having a dye releasable therefrom and an extended portion extending outwardly from the supply reel;

(c) providing a take-up reel disposed in the housing and engaging the extended portion for receiving the dye donor ribbon about the take-up reel, so that the dye donor ribbon extends from the supply reel to the take-up reel;

(d) providing a print head disposed in the housing and adjacent the dye donor ribbon for activating the dye donor ribbon to release the dye therefrom so as to print an image on a recorder medium;

(e) providing a supply tray capable of supplying the recorder medium therefrom and sized to be received in the slot, the tray being inwardly slidable in the slot from a partially inserted position to a more fully inserted position, the tray and the housing defining the exterior envelope; and (f) providing a guide ramp disposed in the housing and extending from near the tray to near the print head for guiding the recorder medium therealong from the tray to the print head, the guide ramp having a hinged end portion disposed adjacent the tray in a first position as the tray partially inserts into the slot and movable to a second position so that the tray more fully inserts into the slot for reducing the exterior envelope.

15. The method of claim 14, wherein said step of providing a guide ramp comprises the step of providing a guide ramp having a hinged end portion disposed adjacent the tray in the first position as the tray partially inserts into the slot and movable to the second position so that the tray fully inserts into the slog for reducing the exterior envelope.

16. The method of claim 14, further comprising the step of providing a spring connected to the hinged end portion of the guide ramp so that the hinged end portion automatically returns to the first position after moving to the second position.

17. The method of claim 14, further comprising the step of providing a locking mechanism connected to the housing and engageable with the tray for locking the tray in the inserted position.

18. The method of claim 14, further comprising the step of providing a release mechanism connected to the housing for releasing the locking mechanism.

* * * * *